US011590760B2

(12) United States Patent
Ishibe et al.

(10) Patent No.: US 11,590,760 B2
(45) Date of Patent: Feb. 28, 2023

(54) LIQUID SUPPLY APPARATUS AND IMAGE RECORDING APPARATUS

(71) Applicant: BROTHER KOGYO KABUSHIKI KAISHA, Nagoya (JP)

(72) Inventors: Akinari Ishibe, Okazaki (JP); Yoshinori Osakabe, Seto (JP); Hiroaki Takahashi, Nagoya (JP); Tatsuya Shindo, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 225 days.

(21) Appl. No.: 16/557,040

(22) Filed: Aug. 30, 2019

(65) Prior Publication Data

US 2020/0070528 A1 Mar. 5, 2020

(30) Foreign Application Priority Data

Aug. 31, 2018 (JP) ..... JP2018-163498

(51) Int. Cl.
*B41J 2/175* (2006.01)

(52) U.S. Cl.
CPC ..... *B41J 2/17523* (2013.01)

(58) Field of Classification Search
None
See application file for complete search history.

(56) References Cited

U.S. PATENT DOCUMENTS 5,963,237 A 10/1999 Ikkatai et al.
6,022,102 A 2/2000 Ikkatai et al.
6,520,630 B1 * 2/2003 Oda ..... B41J 2/17503 347/85
2006/0164478 A1 7/2006 Fukazawa
(Continued)

FOREIGN PATENT DOCUMENTS

JP 10-29318 A 2/1998
JP 2001-187459 7/2001
(Continued)

OTHER PUBLICATIONS

Office Action (Notice of Reasons for Refusal) issued in corresponding Japanese Patent Application No. 2018-163498, dated Jul. 19, 2022.

*Primary Examiner* — Alejandro Valencia
(74) *Attorney, Agent, or Firm* — Merchant & Gould P.C.

(57) ABSTRACT

A liquid supply apparatus includes a tank and a cartridge attachable to and detachable from the tank along an attachment and detachment direction crossing a vertical direction. The cartridge includes a first storing chamber configured to store liquid therein. The tank includes a second storing chamber configured to store liquid therein, a liquid channel and an air channel that communicate with the second storing chamber, and an air communication port allowing the second storing chamber to communicate with an outside thereof. When the cartridge is attached to the tank with the first storing chamber of the cartridge communicating with the liquid channel and the air channel of the tank, the first
(Continued)

storing chamber has a portion located above the liquid channel and the air channel in the vertical direction, and the tank is located below a secondary-lower surface and faces a secondary-front surface.

11 Claims, 9 Drawing Sheets

(56) References Cited

U.S. PATENT DOCUMENTS

| | | | | |
|---|---|---|---|---|
| 2012/0287209 | A1 | 11/2012 | Yan | |
| 2015/0210081 | A1* | 7/2015 | Suzuki | B41J 2/17553 347/86 |
| 2015/0375512 | A1 | 12/2015 | Kondo et al. | |
| 2016/0297205 | A1 | 10/2016 | Takahashi | |
| 2018/0244057 | A1 | 8/2018 | Hayashi et al. | |

FOREIGN PATENT DOCUMENTS

| | | | |
|---|---|---|---|
| JP | 2006-205528 | A | 8/2006 |
| JP | 4934338 | B2 | 5/2012 |
| JP | 2016-159620 | A | 9/2016 |
| JP | 2016-175395 | A | 10/2016 |
| WO | 2015/016119 | A1 | 3/2017 |

* cited by examiner

LIQUID SUPPLY APPARATUS AND IMAGE RECORDING APPARATUS

CROSS-REFERENCE TO RELATED APPLICATION

This application claims priority from Japanese Patent Application No. 2018-163498 filed on Aug. 31, 2018, the content of which is incorporated herein by reference in its entirety.

TECHNICAL FIELD

Aspects of the disclosure relate to a liquid supply apparatus configured to store liquid therein and an image recording apparatus including the liquid supply apparatus.

BACKGROUND

A known printer includes a liquid supply apparatus. The liquid supply apparatus includes a cartridge to store ink therein, a sub tank connected to a recording head, and a liquid channel and an air channel to connect the cartridge and the sub tank. The cartridge is disposed above the sub tank. The liquid channel and the air channel connect the cartridge and the sub tank in a vertical direction. The liquid channel and the air channel are both open to the lower surface of the cartridge and the upper surface of the sub tank.

In the sub tank, the liquid channel extends downward further than the air channel, and the opening of the liquid channel is located above the opening of the air channel. At the cartridge replacement time, the sub tank is free of ink. When a new cartridge is connected to the sub tank, ink in the cartridge flows down into the sub tank via the liquid channel. Air in the sub tank with the same volume of ink having flowed is brought into the cartridge via the air channel. Such air/liquid replacement continues until the opening of the air channel is closed, and thus ink is stored in the sub tank.

During recording, as ink is ejected from the recording head, ink in the sub tank decreases and the ink level in the sub tank lowers away from the opening of the air channel. As the opening of the air channel is released, ink is supplied from the cartridge to the sub tank. The ink level in the sub tank rises with supply of ink and reaches the opening of the air channel. The opening of the air channel is closed and supply of ink from the cartridge is stopped. To compensate the consumption of ink at the recording head, ink is supplied from the cartridge to the sub tank, and thus the ink level in the sub tank is maintained at the level of the opening of the air channel. The sub tank remains mounted in the printer, and an empty cartridge is replaced with an ink-filled cartridge, so that the printer can be used continuously.

SUMMARY

In the above liquid supply apparatus, the cartridge is connected to the sub tank in a vertical direction, and thus needs attaching to and detaching from the sub tank in the vertical direction, i.e., from above. Considering workability, the cartridge may be attached and detached from the front of the printer more conveniently than from above.

If the sub tank and the cartridge are connected side by side horizontally, a volume for storing ink may be increased relative to a space occupied by the sub tank and the cartridge, resulting in a reduced size of the apparatus.

In response to the above issue, one or more aspects of the disclosure provide a liquid supply apparatus with an improved workability of cartridge attachment and detachment.

One or more aspects of the disclosure provide a liquid supply apparatus including a tank and a cartridge attachable to and detachable from the tank in a direction crossing a vertical direction, the liquid supply apparatus having an increased volume for storing liquid relative to a space occupied by a cartridge and a tank.

According to one or more aspects of the disclosure, a liquid supply apparatus includes a tank and a cartridge attachable to and detachable from the tank along an attachment and detachment direction crossing a vertical direction. The cartridge includes a casing, a first storing chamber located inside the casing and configured to store liquid therein, and a particular communication port open in a direction where the cartridge is attached to the tank. The particular communication port allows the first storing chamber to communicate with an outside of the first storing chamber. The direction is parallel to the attachment and detachment direction. The tank includes a second storing chamber configured to store liquid therein, a liquid channel communicating with the second storing chamber, an air channel communicating with the second storing chamber, and an air communication port allowing the second storing chamber to communicate with an outside of the tank. The casing of the cartridge includes a front surface, a rear surface, an upper surface, a lower surface, a secondary-lower surface, and a secondary-front surface. The front surface is located in a front portion of the casing in the attachment and detachment direction. The rear surface is located in a rear portion of the casing in the attachment and detachment direction. The upper surface is located in an upper portion of the casing in the vertical direction. The lower surface is located in a lower portion of the casing in the vertical direction. The secondary-lower surface located closer to the upper surface than the lower surface in the vertical direction. The secondary-lower surface faces downward in the vertical direction. The secondary-front surface is located closer to the rear surface than to the front surface in the attachment and detachment direction. The secondary-front surface faces in the attachment and detachment direction. The secondary-front surface has the particular communication port. When the cartridge is attached to the tank with the first storing chamber of the cartridge communicating with the liquid channel and the air channel of the tank, the first storing chamber has a portion located above the liquid channel and the air channel in the vertical direction, and the tank is located below the secondary-lower surface in the vertical direction and faces the secondary-front surface.

According to the above configuration, the first storing chamber and the second storing chamber are connected to each other via the air channel and the liquid channel, and ink in the first storing chamber can be supplied to the second storing chamber by the air/liquid replacement. The cartridge can be attached to the tank along the attachment and detachment direction crossing the vertical direction. This provides improved workability for cartridge replacement. When the cartridge is attached to the tank, the tank is located below the secondary-front wall of the casing of the cartridge and faces the secondary-front surface. This positional relationship provides increased volumes of the first storing chamber and the second storing chamber relative to respective spaces occupied by the cartridge and the tank.

DETAILED DESCRIPTION

Figure 1A:
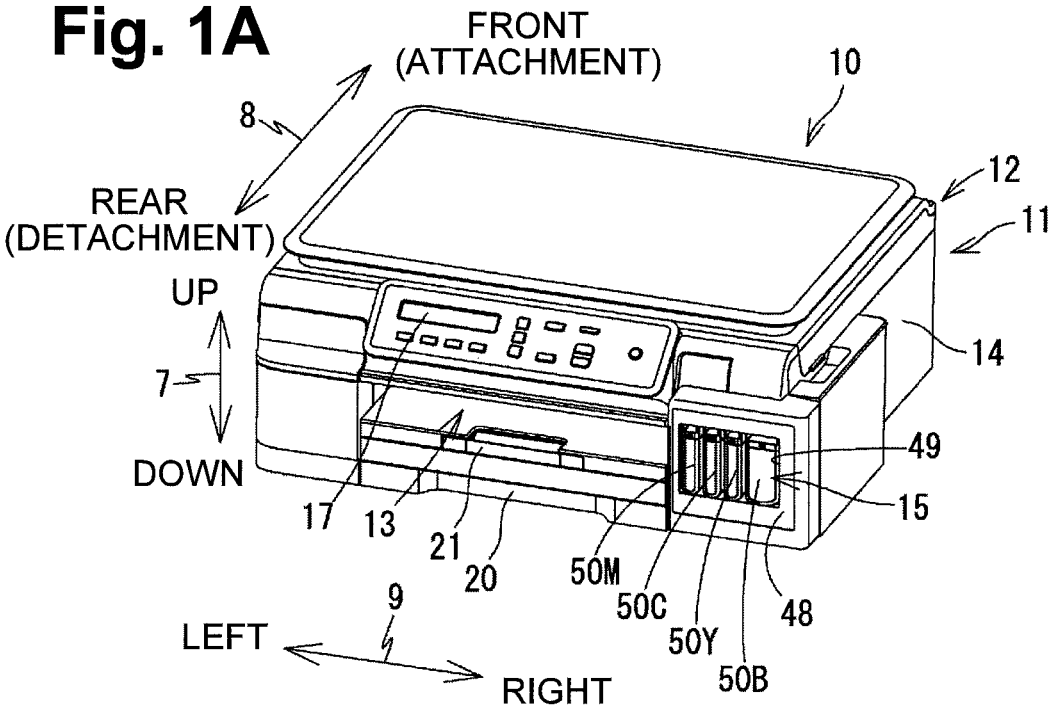
FIG. 1A is a perspective view of a multifunction apparatus with a cover at its closed position according to aspects of the disclosure.

Aspects of the disclosure will be described with reference to the accompany drawings. While the disclosure will be described in detail with reference to particular examples, various changes, arrangements and modifications may be applied therein without departing from the spirit and scope of the disclosure. In the following description, an up-down direction 7 is defined in conjunction with an orientation in which a multifunction apparatus 10 is placed on a horizontal surface or an ink cartridge 50 is attached to the multifunction apparatus 10 (which is an orientation illustrated in FIGS. 1A and 1B, and may refer to a use orientation). An attachment and detachment direction 8 is defined based on that a surface of the multifunction apparatus 10 having an opening 13 is regarded as a surface facing rearward. A left-right direction 9 is defined when the multifunction apparatus 10 is viewed from the front side. In the use orientation in the following description, the up-down direction 7 corresponds to a vertical direction, and the attachment and detachment direction 8 and the left-right direction 9 correspond to a horizontal direction. Regarding the attachment and detachment direction 8, a direction where the ink cartridge 50 is attached to the sub tank 100 is referred to as front, and an opposite direction is referred to as rear.

Embodiment

The following describes the multifunction apparatus 10 and the ink supply apparatus 15 according to an illustrative embodiment.

Structure of Multifunction Apparatus 10

As illustrated in FIG. 1, the multifunction apparatus 10 (as an example of an image recording apparatus) is substantially box shaped. The multifunction apparatus 10 includes a printer 11, a scanner 12, and an operation panel 17. The printer 11 is disposed in a lower portion of the multifunction apparatus 10 and is configured to record an image on a sheet (FIG. 2) using inkjet recording method. The scanner 12 is a device with scan function and disposed above the printer 11. The printer 11 includes a casing 14 with an opening 13 that is open rearward in the attachment and detachment direction 8, and the ink supply apparatus 15 that is located to the right of the opening 13 in the casing 14. The operation panel 17 is located to the rear of the scanner 12 in the attachment and detachment direction 8. The operation panel 17 has user selection keys to cause the multifunction apparatus 10 to execute functions regarding image recording by the printer 11 and image reading by the scanner 12.

Figure 2:
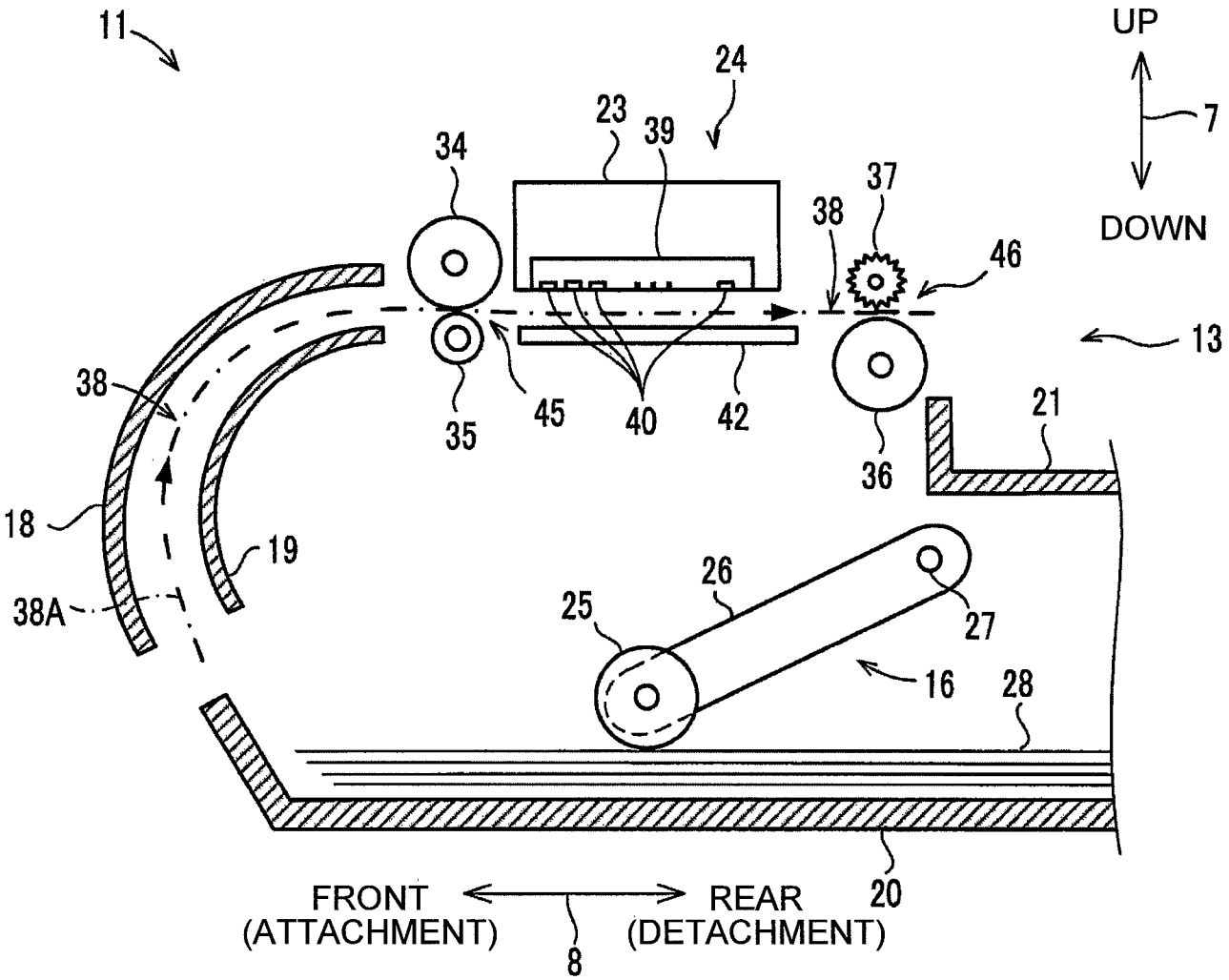
FIG. 2 is a sectional view schematically illustrating an internal configuration of a printer of the multifunction apparatus according to aspects of the disclosure.

As illustrated in FIG. 2, the printer 11 includes, in the casing 14, a feeder 16, a sheet feed tray 20, a sheet discharge tray 21, a conveying roller pair 45, a recording unit 24, a discharge roller pair 46, and a platen 42.

Sheet Feed Tray and Sheet Discharge Tray

As illustrated in FIG. 1, the sheet feed tray 20 is insertable through the opening 13 into the casing 14. The opening 13 is defined in a front surface of the multifunction apparatus 10 and in a central portion thereof in the left-right direction 9. As illustrated in FIG. 2, the sheet feed tray 20 is configured to support a stack of sheets 28. The sheet discharge tray 21 is disposed above the sheet feed tray 20 and is removable in attachment and detachment direction 8 together with the sheet feed tray 20. The sheet discharge tray 21 supports a sheet 28 discharged by the discharge roller pair 46.

Feeder 16

The feeder 16 is configured to feed a sheet 28 supported on the sheet feed tray 20 toward a conveyance path 38. As illustrated in FIG. 2, the feeder 16 includes a feed roller 25, an arm 26 and a shaft 27. The feed roller 25 is rotatably supported at an end of the arm 26. The feed roller 25 receives a driving force from a motor, not illustrated. The arm 26 is pivotally supported by the shaft 27 supported by a frame of the printer 11. The arm 26 is urged by its own weight or an elastic force, for example, a spring, toward the sheet feed tray 20.

In the following description, when the feed roller 25, a conveying roller 34, and a discharge roller 36 rotate about a respective rotational axis to convey a sheet 28 in a conveyance direction 38A, their rotation refers to forward rotation.

Conveyance Path 38

Figure 3:
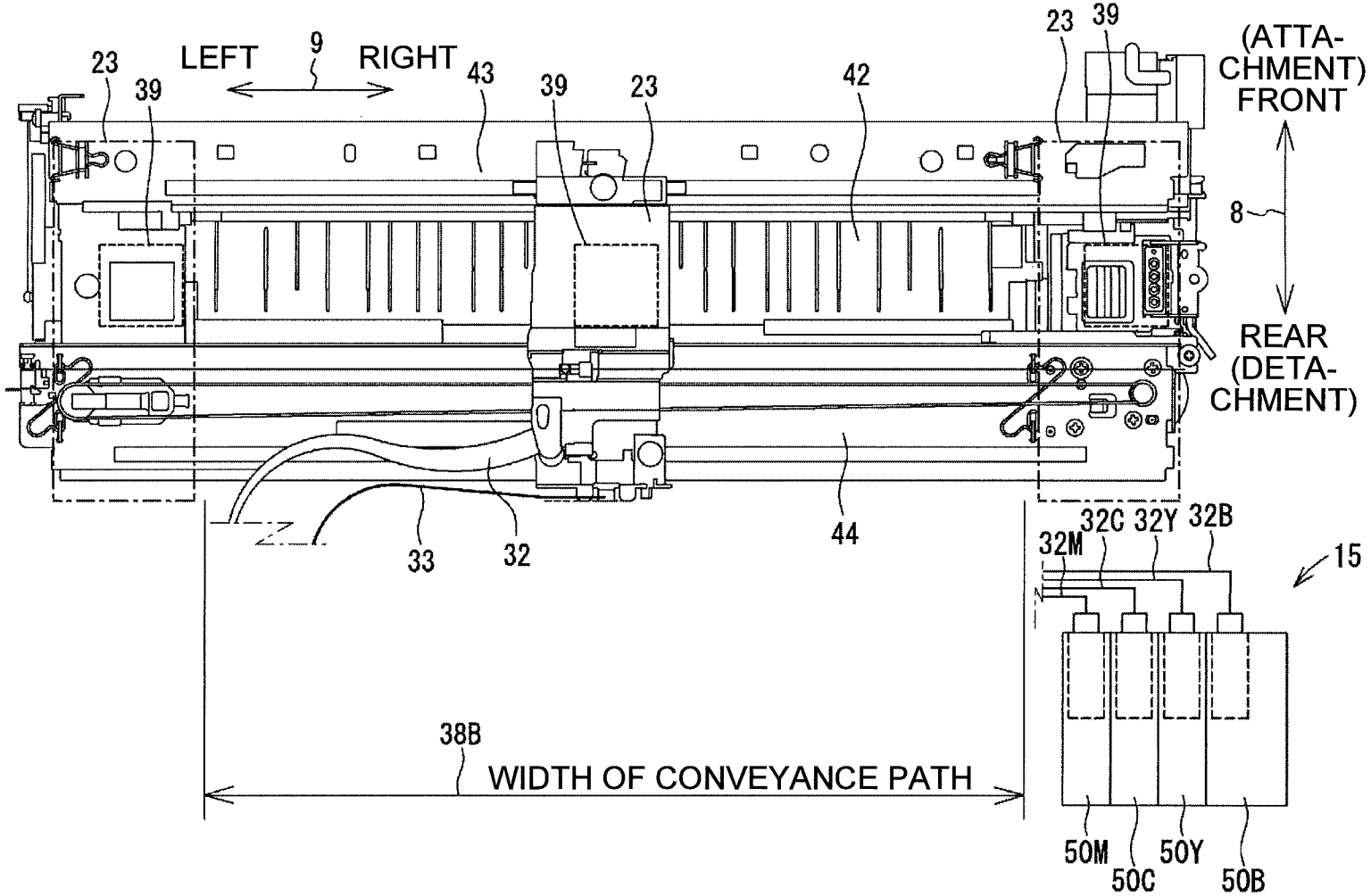
FIG. 3 is a plan view of a carriage and an ink supply apparatus according to aspects of the disclosure.

As illustrated in FIG. 2, the conveyance path 38 refers to a space defined, partially in the printer 11, between an outer guide member 18 and an inner guide member 19 facing each other. The conveyance path 38 extends from the sheet feed tray 20 frontward in the attachment and detachment direction 8. The conveyance path 38 is curved upward from the sheet feed tray 20 toward the rear in the attachment and detachment direction 8, reaching the sheet discharge tray 21 via a space between the recording unit 24 and the platen 42. As illustrated in FIGS. 2 and 3, the conveyance path 38 extending between the conveying roller pair 45 and the discharge roller pair 46 is located at a central portion of the multifunction apparatus 10 in the left-right direction 9, and extends in the attachment and detachment direction 8. The conveyance direction 38A in the conveyance path 38 is indicated by an arrow in FIG. 2.

Conveyance Roller Pair 45

As illustrated in FIG. 2, the conveying roller pair 45 is disposed upstream from the recording unit 24 in the conveyance direction 38A. The conveyor roller pair 45 includes a conveying roller 34 and a pinch roller 35. The conveying roller 34 is configured to receive a driving force from a motor, not illustrated, and rotate in both forward and reverse directions. The pinch roller 35 is configured to rotate with the rotation of the conveying roller 34. A sheet 28 is pinched between the conveying roller 34 rotating in forward direction and the pinch roller 35, and fed in the conveyance direction 38A.

Discharge Roller Pair 46

As illustrated in FIG. 2, the discharge roller pair 46 is disposed downstream from the recording unit 24 in the conveyance direction 38A. The discharge roller pair 46 includes a discharge roller 36 and a spur 37. The discharge roller 36 is configured to receive a driving force from a motor, not illustrated, and rotate in both forward and reverse directions. The spur 37 is configured to rotate with the rotation of the discharge roller 36. A sheet 28 is pinched between the discharge roller 36 rotating in forward direction and the spur 37, and fed in the conveyance direction 38A.

Recording Unit 24

As illustrated in FIG. 2, the recording unit 24 is disposed between the conveying roller pair 45 and the discharge roller pair 46 in the conveyance direction 38A. The recording unit 24 faces downwardly toward the platen 42 via the conveyance path 38 in the up-down direction 7. The recording unit 24 includes the carriage 23 and a recording head 39 mounted on the carriage 23.

As illustrated in FIG. 3, the carriage 23 is supported by guide rails 43, 44, which are spaced apart from each other in the attachment and detachment direction 8 and each extending in the left-right direction 9. The guide rails 43, 44 are supported by a frame, not illustrated. The carriage 23 is connected a known belt mechanism disposed on the guide rail 44. The belt mechanism includes a belt, which is configured to receive a driving force from a carriage-driving motor, not illustrated. The carriage 23 is guided by the guide rails 43, 44 along with the rotational movement of the belt mechanism, and reciprocates in the left-right direction 9. The carriage 23 moves to the left and right beyond the width 38A of the conveyance path 38 as indicated by a dot-and-dash line in FIG. 3.

The recording head 39 is connected to four sub tanks 100 (FIG. 6) disposed in the ink supply apparatus 15 with four ink tubes 32. The recording head 39 is connected to a control circuit board, not illustrated, via a flexible flat cable 33.

The four sub tanks 100 include a magenta sub tank 100, a cyan sub tank 100, a yellow sub tank 100, and a black sub tank 100. The magenta sub tank 100, cyan sub tank 100, yellow sub tank 100 and black sub tank 100 are collectively referred to as a sub tank 100 or sub tanks 100 unless otherwise specified in the following description.

The four ink tubes 32 include a yellow ink tube 32Y, a cyan ink tube 32C, a magenta ink tube 32M, and a black ink tube 32B. The yellow ink tube 32Y, cyan ink tube 32C, magenta ink tube 32M, and black ink tube 32B are collectively referred to as an ink tube 32 or ink tubes 32 unless otherwise specified in the following description. The four ink tubes 32 are tied in a bundle.

The flexible flat cable 33 electrically connects the control circuit board with a controller mounted thereon and the recording head 39. The flexible flat cable 33 transmits a control signal outputted from the controller to the recording head 39.

As illustrated in FIG. 2, the recording head 39 has a lower surface formed with a plurality of nozzles 40. The nozzles 40 are exposed from the lower surface of the recording head 39. The recording head 39 ejects micro ink droplets from the nozzles 40. While the carriage 23 moves, the recording head 39 ejects ink droplets toward a sheet 28 supported by the platen 42. Thus, an image is recorded on the sheet 28. Ink stored in the four sub tanks 100 is consumed accordingly.

Platen 42

As illustrated in FIGS. 2 and 3, the platen 42 is disposed between the conveying roller pair 45 and the discharge roller pair 46 in the conveyance path 38. The platen 42 is disposed below and faces upwardly toward the recording unit 24 via the conveyance path 38 in the up-down direction 7. The platen 42 supports a sheet 28, which is conveyed by the conveying roller pair 45, from below.

Cover 48

Figure 1B:
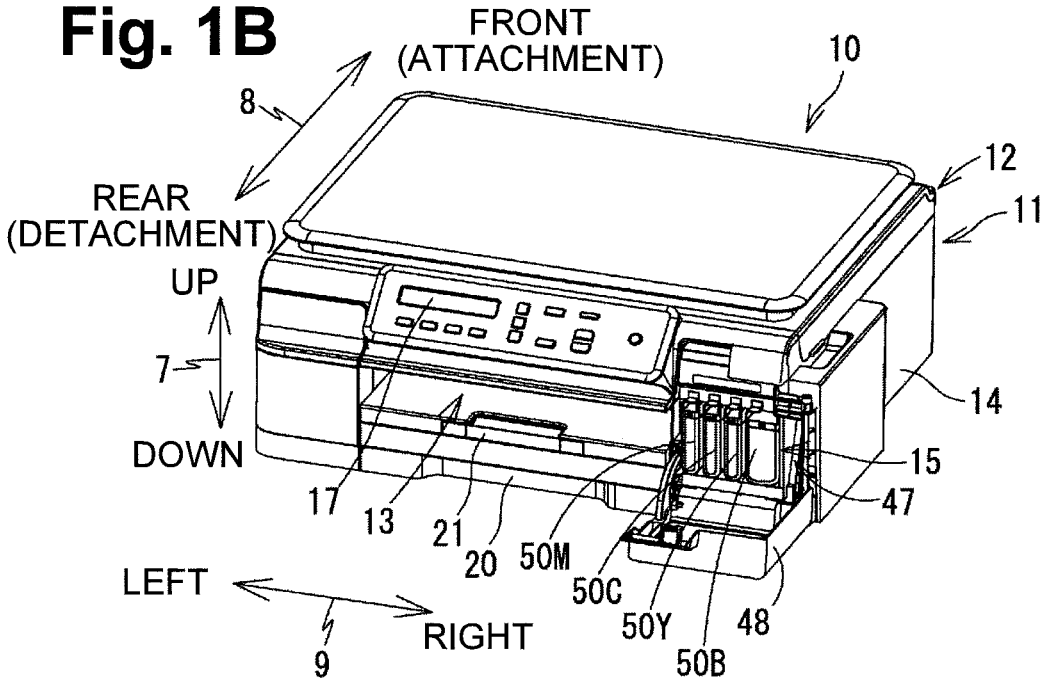
FIG. 1B is a perspective view of the multifunction apparatus with the cover at its open position according to aspects of the disclosure.
Figure 4:
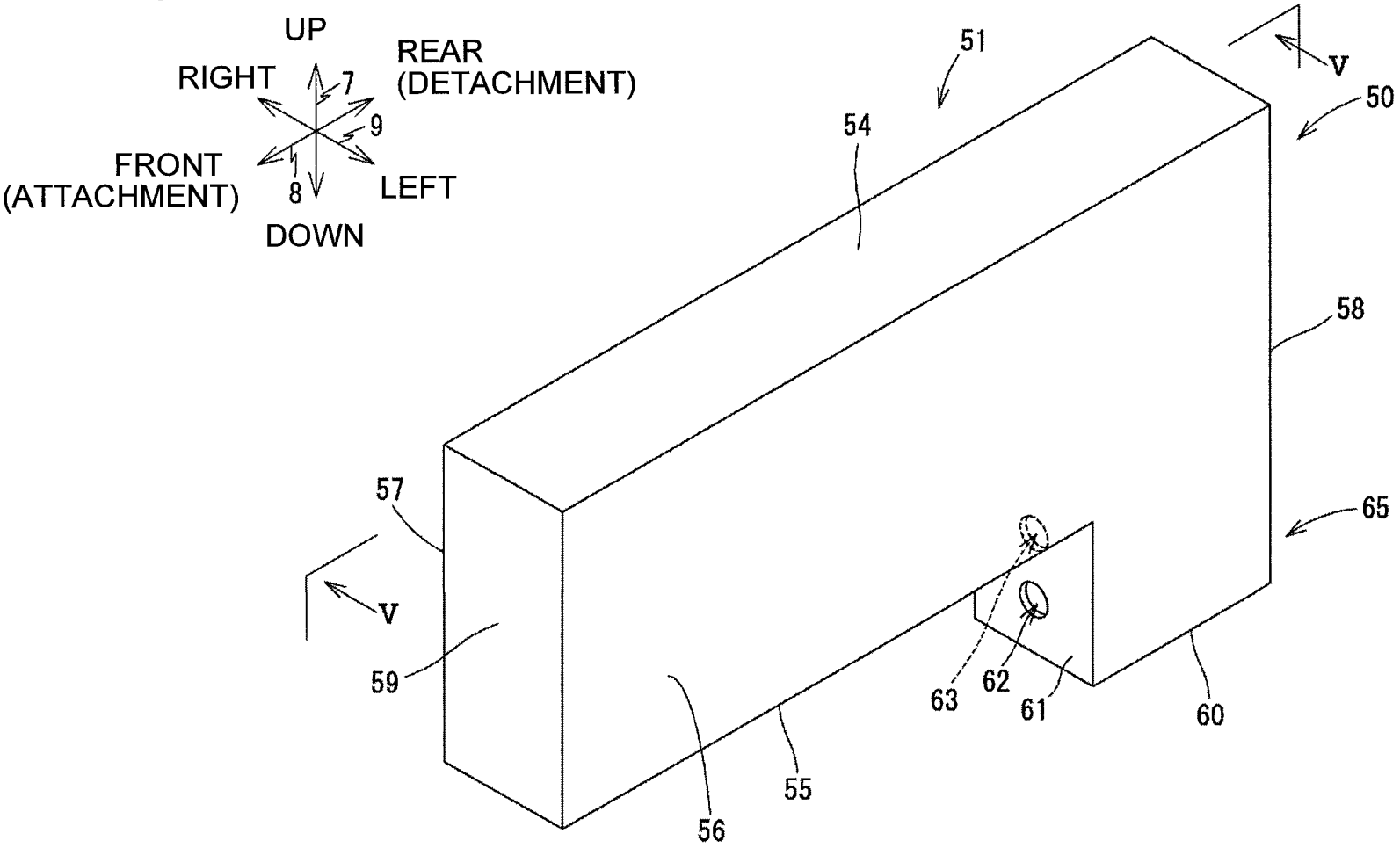
FIG. 4 is a perspective view of an ink cartridge according to aspects of the disclosure.

As illustrated in FIG. 1B, the casing 14 has an opening 47 at a front right portion of the casing 14. The casing 14 accommodates the ink supply apparatus 15, and ink cartridges 50 are illustrated as being exposed from the opening 47 at their rear walls 58 (FIG. 4). The casing 14 includes a cover 48 to open and close the opening 47. The cover 48 has its lower end supported below the opening 47 by the casing 14 such that the cover 48 is pivotable about a shaft extending in the left-right direction 9. The cover 48 is pivotable between a closed position (FIG. 1A) to close the opening 47 and an open position (FIG. 1B) to open the opening 47.

As illustrated in FIG. 1A, the cover 48 includes a light-transmissive window 49. The light-transmissive window 49 is transparent to light to see inside from outside of the cover 48. When the cover 48 is at the closed position, the rear walls 58 of the ink cartridges 50 attached to the ink supply apparatus 15 are visible through the light-transmissive window 49.

Ink Supply Apparatus 15

Figure 6:
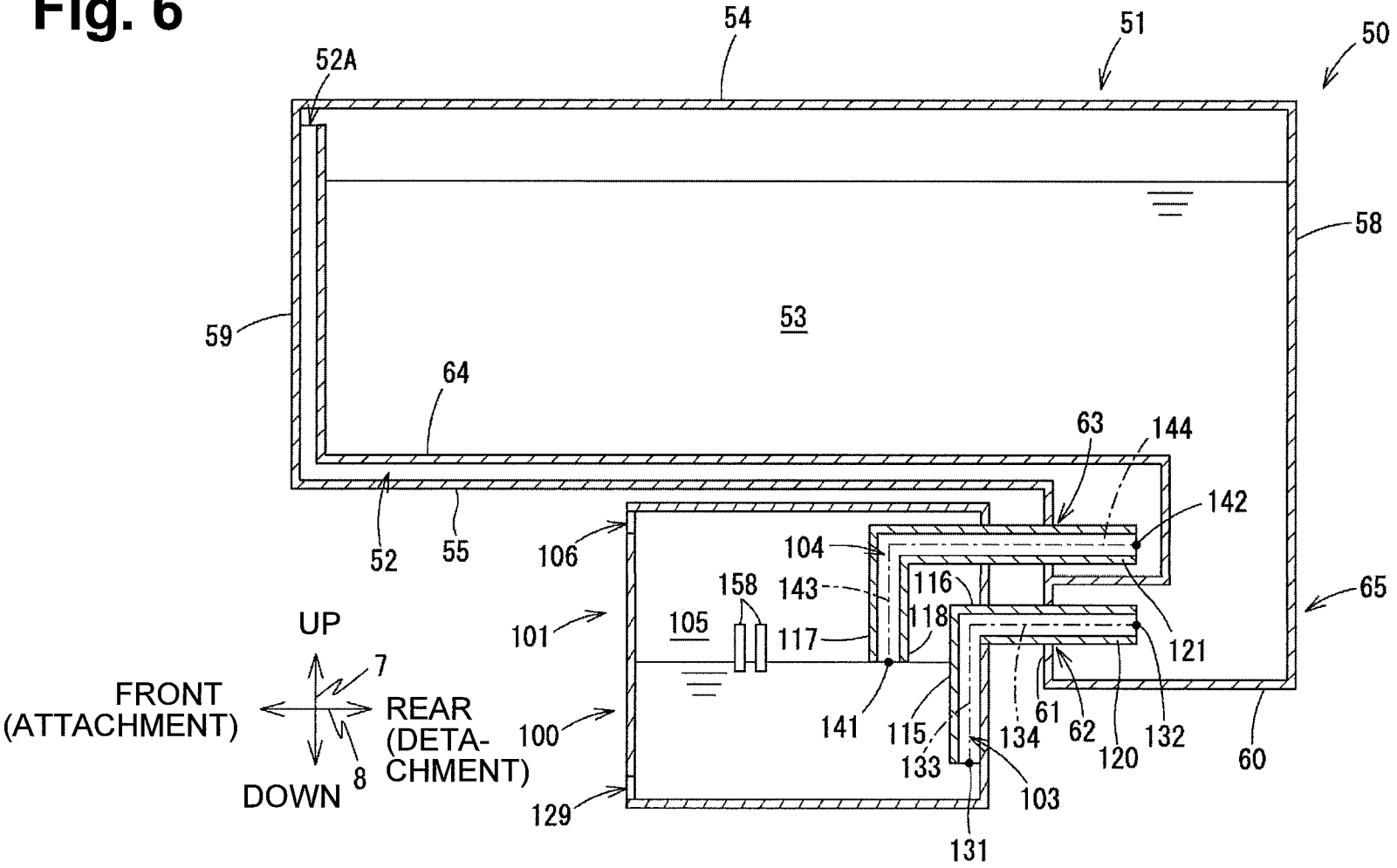
FIG. 6 is a sectional view of an ink cartridge and a sub tank, which are in an attached state, according to aspects of the disclosure.

As illustrated in FIG. 3, the ink supply apparatus 15 (as an example of a liquid supply apparatus) includes four ink cartridges 50 and four sub tanks 100 (FIG. 6).

Ink Cartridge 50

As illustrated in FIGS. 1A, 1B, and 3, four ink cartridges 50 (as an example of a cartridge) include a magenta ink cartridge 50M, a cyan ink cartridge 50C, a yellow ink cartridge 50Y, and a black ink cartridge 50B. The magenta ink cartridge 50M, cyan ink cartridge 50C, yellow ink cartridge 50Y, and black ink cartridge 50B are collectively referred to as an ink cartridge 50 or ink cartridges 50 unless otherwise specified in the following description.

Figure 5:
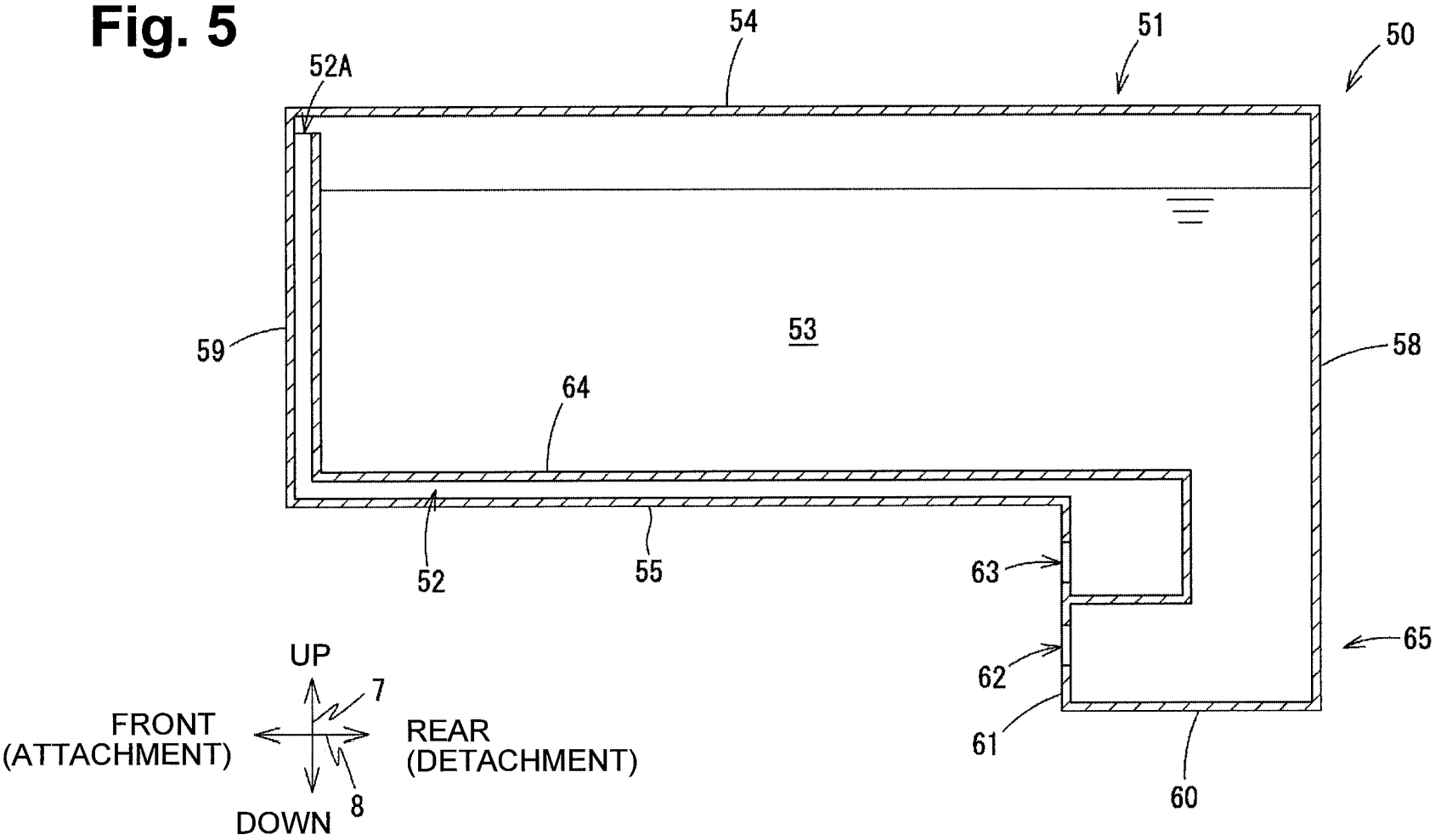
FIG. 5 is a sectional view taken along a line V-V of FIG. 4 according to aspects of the disclosure.

As illustrated in FIGS. 4 and 5, an ink cartridge 50 includes a cartridge casing 51. The cartridge casing 51 has a first storing chamber 53 for storing ink (as an example of liquid), and communication ports 62, 63.

The cartridge casing 51 is substantially box-shaped. The cartridge casing 51 is of a rectangle when viewed in the up-down direction 7 and the attachment and detachment direction 8. The cartridge casing 51 includes, at its rear end portion, a protrusion 65 protruding downward. The cartridge casing 51 has an upper wall 54, a secondary-lower wall 55, a right wall 56, a left wall 57, a rear wall 58, a front wall 59, a lower wall 60, and a secondary-front wall 61. The outer surfaces of the upper wall 54, the secondary-lower wall 55, the right wall 56, the left wall 57, the rear wall 58, the front wall 59, the lower wall 60, and the secondary-front wall 61 respectively correspond to an upper surface, a secondary-lower surface, a left surface, a rear surface, a front surface, a lower surface, and a secondary-front surface, respectively. The cartridge casing 51 has a front face facing frontward in the attachment and detachment direction 8.

The front wall 59 is located in a front portion of the cartridge casing 51, and is located above the secondary-front wall 61. The secondary-front wall 61 is located closer to the rear wall 58 than to the front wall 59. The secondary-front wall 61 is located below the secondary-lower wall 55. The lower wall 60 is located at a lower end of the cartridge casing 51, extends to a rear portion thereof, and is located below the secondary-lower wall 55. The secondary-lower wall 55 is located closer to the front than the lower wall 60 in the attachment and detachment direction 8. The right wall 56, the left wall 57, the rear wall 58, the lower wall 60, and the secondary-front wall 61 define an outline of the protrusion 65.

The cartridge casing 51 has communication ports 62, 63 in the secondary-front wall 61 defining the protrusion 65. The communication ports 62, 63 are open to the front in the attachment and detachment direction 8. The communication port 62 is below the communication port 63 in the up-down direction 7. Although not illustrated, the communication ports 62, 63 are openable to the outside by known valves.

As illustrated in FIG. 5, the cartridge casing 51 has a cartridge air channel 52 and a first storing chamber 53. The cartridge air channel 52 connects the communication port 63 and an air layer contained in the first storing chamber 53 storing an initial volume of ink. The cartridge air channel 52 is a space defined by the secondary-lower wall 55, the right wall 56, the left wall 57, the front wall 59, the secondary-front wall 61, which constitute the cartridge casing 51, and a partition wall 64, which is located inside the cartridge casing 51.

The partition wall 64 inside the cartridge casing 51 extends from between the communication port 62 and the communication port 63 in the secondary-front wall 61 rearward in the attachment and detachment direction 8, extends upward from a position spaced from the rear wall 58 toward a position above the secondary-lower wall 55, extends frontward in the attachment and detachment direction 8 from the position above the secondary-lower wall 55 toward a position spaced from the front wall 59, and then extends upward from the position spaced from the front wall 59. The partition wall 64 is connected to the right wall 56 and the left wall 57 in the left-right direction 9. The partition wall 64 partitions the internal space in the cartridge casing 51 into the cartridge air channel 52 and the first storing chamber 53. The cartridge air channel 52 has its upper end defining an opening 52A that is open to the air layer of the first storing chamber 53. The opening 52A at the upper end of the cartridge air channel 52 may be covered and uncovered with a lid movable in response to attachment and detachment of the cartridge 50 to and from the sub tank 100, or be sealed with a semipermeable membrane, which allows air to pass through it and disallows ink to pass through it.

Sub Tank 100

As illustrated in FIG. 6, a sub tank 100 (as an example of a tank) includes a tank body 101 and joints 120, 121. The tank body 101 includes, inside, a second storing chamber 105 configured to store ink therein. The joints 120, 121 are shaped like a tube, and extend from the rear wall of the tank body 101 rearward in the attachment and detachment direction 8. Each of the joints 120, 121 has an internal space communicating with the second storing chamber 105 via a respective through hole in the rear wall of the tank body 101. The joint 120 is below the joint 121 in the up-down direction 7.

The sub tank 100 includes a liquid channel 103 and an air channel 104, which communicate with the second storing chamber 105. The liquid channel 103 is defined inside the tank body 101 and the joint 120 (as an example of a first joint). The air channel 104 is defined inside the tank body 101 and the joint 121 (as an example of a second joint). The sub tank 100 includes an air communication port 106, which allows the second storing chamber 105 to communicate with outside.

Liquid Channel 103 and Air Channel 104

The liquid channel 103 has a first opening 131, a second opening 132, a vertical portion 133, and a horizontal portion 134. The first opening 131 is formed at one end of the liquid channel 103 and communicates with the second storing chamber 105. The first opening 131 is open downward along the up-down direction 7. The second opening 132 is formed at the other end of the liquid channel 103 and communicates with an outside of the liquid channel 103. The second opening 132 is open toward the rear along the attachment and detachment direction 8. The second opening 132 is located inside the first storing chamber 53 of the ink cartridge 50 attached to the sub tank 100. The vertical portion 133 defines a portion of the liquid channel 103 extending upward from the first opening 131. The horizontal portion 134 defines a portion of the liquid channel 103, extending from the second opening 132 frontward in the attachment and detachment direction 8. The vertical portion 133 has its upper end connected to the front end of the horizontal portion 134.

The air channel 104 has a third opening 141, a fourth opening 142, a vertical portion 143, and a horizontal portion 144. The third opening 141 is formed at one end of the air channel 104 and communicates with the second storing chamber 105. The third opening 141 is open downward along the up-down direction 7. The fourth opening 142 is formed at the other end of the air channel 104 and is open to an outside. The fourth opening 142 is open toward the rear along the attachment and detachment direction 8. The fourth opening 142 communicates with the first storing chamber 53 of the ink cartridge 50 attached to the sub tank 100. The vertical portion 143 defines a portion of the air channel 104 extending upward from the third opening 141. The horizontal portion 144 defines a portion of the air channel 104, extending from the fourth opening 142 frontward in the attachment and detachment direction 8. The vertical portion 143 has its upper end connected to the front end of the horizontal portion 144.

Tank Body 101

The tank body 101 has outside walls defining substantially a box shape. The sub tank 100 has a lower wall formed with a communication port 129, which communicates with the second storing chamber 105. The communication port 129 receives one end of the ink tube 32, which allows the second storing chamber 105 to communicate with the recording head 39. The tank body 101 has a front wall formed with the air communication port 106 passing therethrough near its upper end. The second opening 105 communicates with outside via the air communication port 106.

The tank body 101 includes a vertical wall 115 at its rear portion and a horizontal wall 116 at its upper portion. The vertical wall 115 extends in the up-down direction 7 and is located between the rear wall and the upper wall of the tank body 101 in the attachment and detachment direction 8. The vertical wall 115 extends to left and right side walls of the tank body 101. The vertical wall 115 has its lower end that defines the position of the first opening 131 of the liquid channel 103 in the up-down direction 7.

The horizontal wall 116 extends rearward from an upper end of the vertical wall 115. The tank body 101 defines the vertical portion 133 of the liquid channel 103 between its outer wall (rear wall), the vertical wall 115 and the horizontal wall 116.

As illustrated in FIG. 6, the vertical portion 143 of the air channel 104 and front portion of the horizontal portion 144 of the air channel 104 are defined by two bend walls 117, 118. The bend wall 117 extends from upper portion of the joint 121 in the outer wall (rear wall) of the tank body 101 to the front and then downward. The bend wall 118 extends from lower portion of the joint 121 in the outer wall (rear wall) of the tank body 101 to the front and then downward. The bend walls 117, 118 extend to left and right side walls of the tank body 101. The bend walls 117, 118 defines the air channel 104 therebetween. The bend walls 117, 118 have their lower ends located above the lower end of the vertical wall 115.

Attached State of Ink Cartridge 50

As illustrated in FIG. 6, the ink cartridge 50 is attached to the sub tank 100 with the joint 120 of the sub tank 100 inserted into the communication port 62 of the ink cartridge 50 along the attachment and detachment direction 8. The joint 121 of the sub tank 100 is inserted into the communication port 63 of the ink cartridge 50 along the attachment and detachment direction 8. In the attached state, the second opening 132 of the liquid channel 103 of the sub tank 100 is located in the first storing chamber 53 of the ink cartridge 50. The fourth opening 142 of the air channel 104 of the sub tank 100 is located in the cartridge air channel 52 of the ink cartridge 50. The ink cartridge 50 is attachable to and detachable from the sub tank 100 along the attachment and detachment direction 8.

Layout of Ink Cartridge 50 and Sub Tank 100

The following describes a layout of the ink cartridge 50 and the sub tank 100 based on the ink cartridge 50 and the sub tank 100 which are at the use orientation illustrated in FIG. 6.

As illustrated in FIG. 6, the tank body 101 of the sub tank 100 is located below the secondary-lower wall 55 of the ink cartridge 50 in the up-down direction 7 and faces the secondary-front wall 61. The protrusion 65 of the ink cartridge 50 is located at substantially the same level as the joints 120, 121 in the up-down direction 7, and a portion of the ink cartridge 50 above the protrusion 65 is located above the joints 120, 121. Thus, the most part of the first storing chamber 53 of the ink cartridge 50 is located above the joints 120, 121.

The tank body 101 has an upper portion located at substantially the same as the joints 120, 121, and a lower portion located below the joints 120, 121. The tank body 101 thus stores ink in the second storing chamber 105 below the joints 120, 121.

The first storing chamber 53 has an upper portion located above the protrusion 65. The upper portion is located above the horizontal portion 134 of the liquid channel 103 and the horizontal portion 144 of the air channel 104. The portion of the second storing chamber 105 that stores ink therein is located below the horizontal portion 134 of the liquid channel 103 and the horizontal portion 144 of the air channel 104. The lower portion of the first storing chamber 53 and the upper portion of the second storing chamber 105 are aligned in the attachment and detachment direction 8. The first storing chamber 53 has a greater capacity than the second storing chamber 105 has.

The horizontal portion 144 of the air channel 104 is located above the horizontal portion 134 of the liquid channel 103.

Flows of Ink and Air

The following describes flows of ink and air between the ink cartridge 50 and the sub tank 100 in an initial-ink-supply operation when the ink cartridge 50 is attached to the empty sub tank 100 for the first time.

Before the initial-ink-supply operation, the ink cartridge 50 is not attached to the sub tank 100. Thus, the second storing chamber 105 stores no ink or is empty.

As illustrated in FIG. 6, when the ink cartridge 50 is attached to the sub tank 100, the communication port 62 of the ink cartridge 50 receives the joint 120 of the sub tank 100, and the communication port 63 of the ink cartridge 50 receives the joint 121 of the sub tank 100. The lower portion of the first storing chamber 53 thus communicates with the second storing chamber 105 via the liquid channel 103. Simultaneously, the air layer of the first storing chamber 53 communicates with the second storing chamber 105 via the cartridge air channel 52 and the air channel 104. This allows ink in the first storing chamber 53 of the ink cartridge 50 to free-fall via the liquid channel 103 and flow into the second storing chamber 105. Air with the same volume of ink having flowed into the second storing chamber 105 flow into the first storing chamber 53 via the air channel 104 and the cartridge air channel 52. Thus, ink in the first storing chamber 53 is replaced with air (air/liquid replacement), and supplied to the second storing chamber 105.

The ink level in the second storing chamber 105 rises as the ink flows into the second storing chamber 105. The ink level rises to the lower ends of the bend walls 117, 118 until the ink closes the third opening 141 of the air channel 104. While the ink closes the third opening 141, the ink does not flow into the second storing chamber 105 from the first storing chamber 53. This is how the ink is supplied in the initial-ink-supply operation. While the ink is left between the ink detection plates 158, electric current flows between the ink detection plates 158. Thus, detecting the electric current flow may indicate that the ink level in the second storing chamber 105 has risen to a predetermined level.

The following describes flows of ink and air between the ink cartridge 50 and the sub tank 100 when the printer 11 performs recording while the ink cartridge 50 is attached to the sub tank 100.

During recording, as ink is ejected from the recording head 39, ink in the second storing chamber 105 is drawn through the communication port 129 to the recording head 39. As ink in the second storing chamber 105 decreases, its ink level lowers away from the third opening 141 of the air channel 104, air corresponding to a volume of the decreased ink is drawn through the air communication port 106 to the second storing chamber 105, and the third opening 141 of the air channel 104 is released. Then, ink to compensate the decreased ink is supplied from the first storing chamber 53 to the second storing chamber 105 as the same volume of air flows out from the second storing chamber 105 to the first storing chamber 53 through the third opening 141. Thus, the ink level in the second storing chamber 105 is back to the level of the third opening 141 of the air channel 104. In this manner, the air/liquid replacement continuously occurs during recording.

After the ink level in the first storing chamber 53 becomes lower below the second opening 132, the ink level in the second storing chamber 105 gradually lowers every time ink is ejected from the recording head 39, and the third opening 141 of the air channel 104, which has been closed by ink, is released. When the ink level in the second storing chamber 105 further lowers until no ink is left between the ink detection plates 158, no or lower electric current flows between the ink detection plates 158. Thus, detecting no or lower electric current flow may indicate that the ink level in the second storing chamber 105 has lowered to a predetermined level so that the multifunction apparatus 10 outputs information that the first storing chamber 53 of the ink cartridge 50 becomes "empty" though a little ink remains below the second opening 132 in the first storing chamber 53. The "empty" ink cartridge 50 may be replaced with a new one filled with ink, and the multifunction apparatus 10 can thus performs recording operation thereafter.

Effects

The first storing chamber 53 and the second storing chamber 105 are connected to each other via the liquid channel 103 and the air channel 104, and ink in the first storing chamber 53 can be supplied to the second storing chamber 105 by the air/liquid replacement. The ink cartridge 50 can be attached to the sub tank 100 along the attachment and detachment direction 8 that is a horizontal direction. This provides improved workability for attachment and detachment of the ink cartridge 50. When the ink cartridge 50 is attached to the sub tank 100, the sub tank 100 is located below the secondary-lower wall 55 of the cartridge casing 51 and faces the secondary-front wall 61. This positional relationship provides increased volumes of the first storing chamber 53 and the second storing chamber 105 relative to the respective spaces occupied by the ink cartridge 50 and the sub tank 100.

The joint 120 defines the liquid channel 103, and the joint 121 defines the air channel 104. This allows easy design of the liquid channel 103 and the air channel 104 separated from each other in the up-down direction 7. The separation of the liquid channel 103 and the air channel 104 in the up-down direction 7 increases a difference in hydraulic head and therefore facilitates ink flow from the first storing chamber 53 down to the second storing chamber 105.

The opening 52A at the upper end of the cartridge air channel 52 is located above the liquid surface of an initial volume of ink stored in the first storing chamber 53. This reduces air, which is to be flowed from the second storing chamber 105 through the air channel 104 and the cartridge air channel 52 to the first storing chamber 53, from entering the liquid channel 103.

The ink cartridge 50 can be attached to the sub tank 100 along the attachment and detachment direction 8 that is a horizontal direction. This facilitates attachment and detachment of the ink cartridge 50.

Alternative Embodiment

Figure 7:
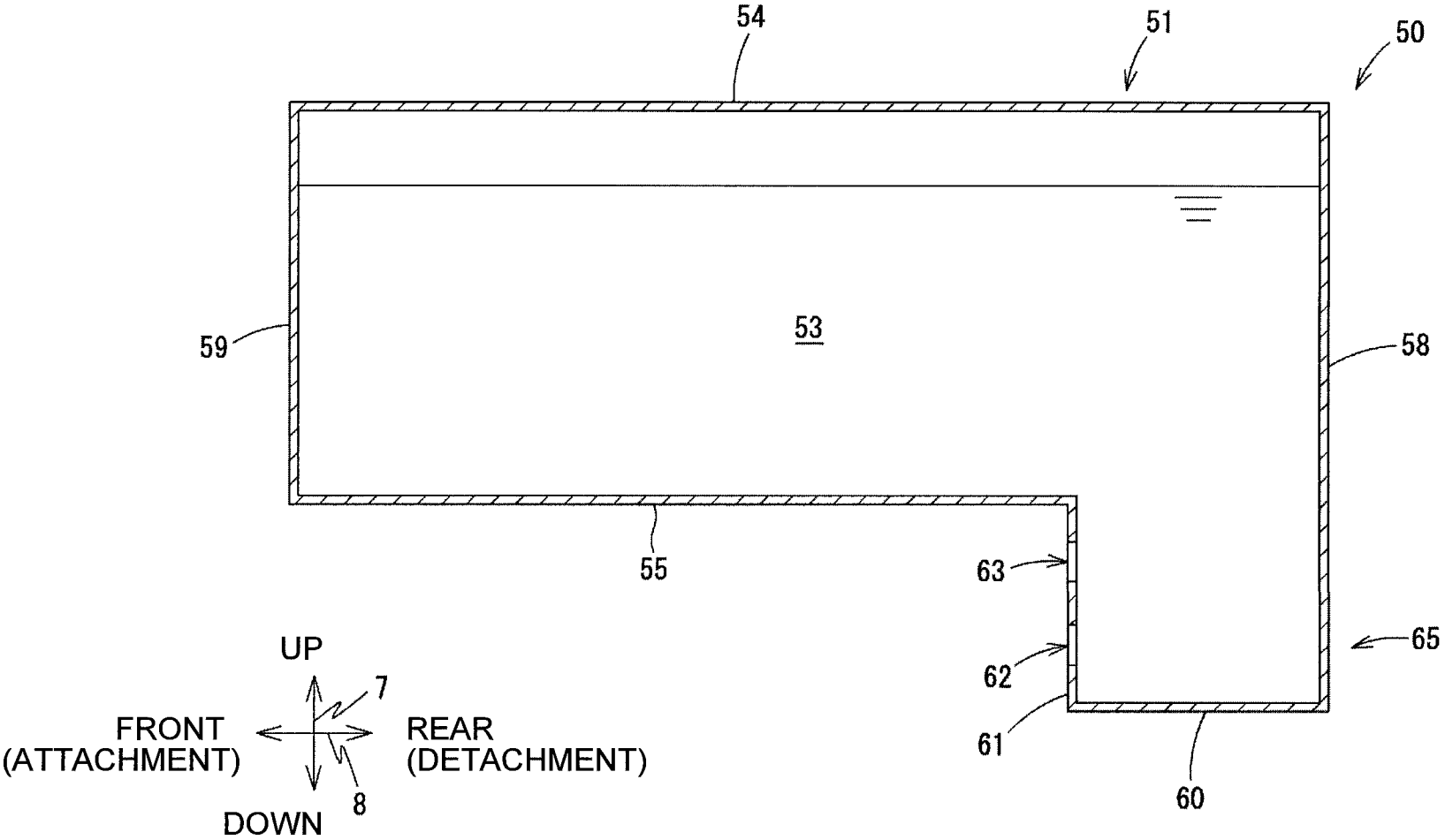
FIG. 7 is a sectional view of an ink cartridge according to aspects of the disclosure.
Figure 8:
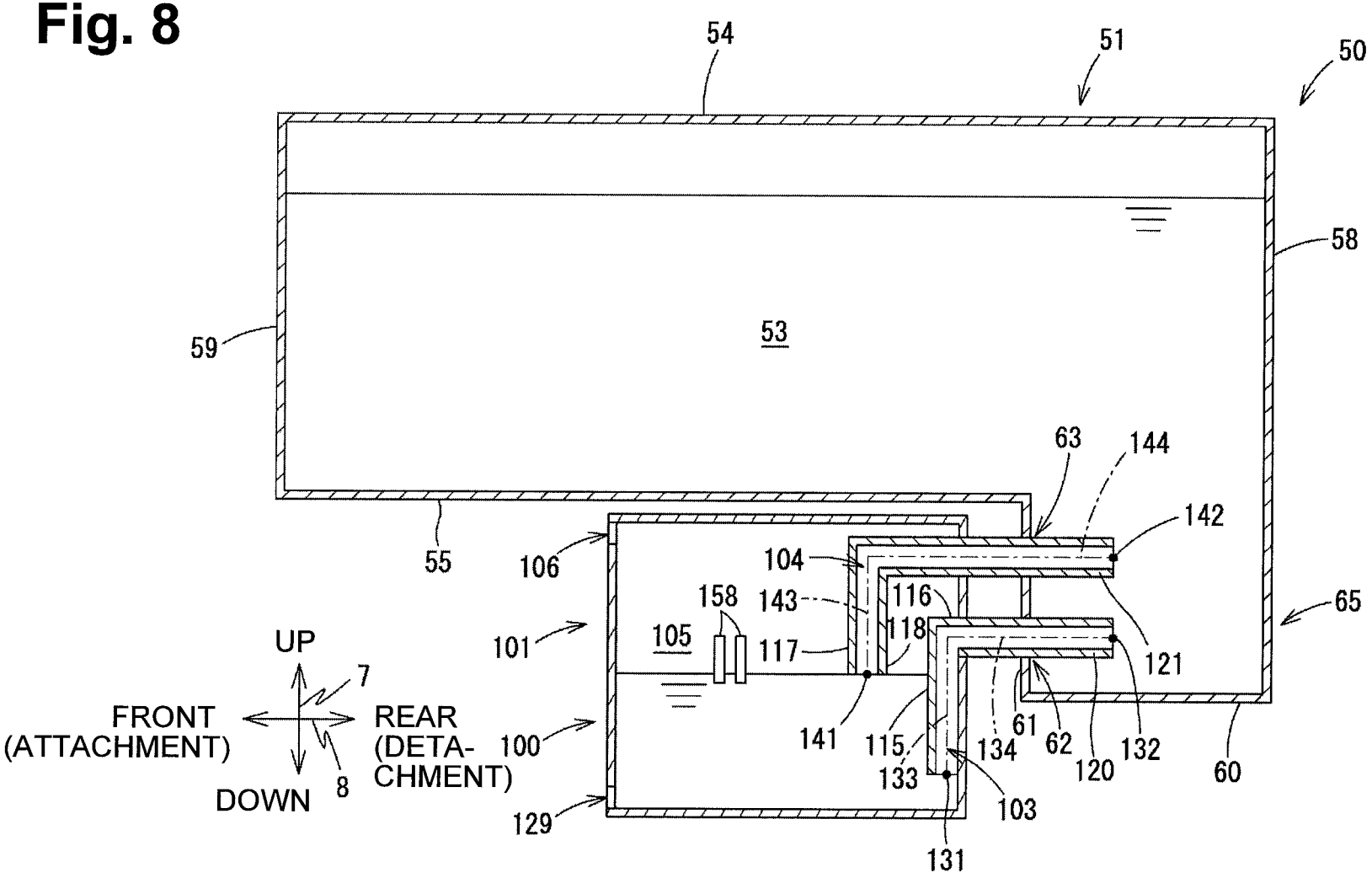
FIG. 8 is a sectional view of an ink cartridge and a sub tank, which are in an attached state, according to aspects of the disclosure.

In the ink supply apparatus 15 according to the above embodiment, the ink cartridge 50 includes the cartridge air channel 52 and the first storing chamber 53. As illustrated in FIG. 7, the ink cartridge 50 may not include the cartridge air channel 52. In this case, as illustrated in FIG. 8, the fourth opening 142 of the air channel 104 is located inside the first storing chamber 53 of the ink cartridge 50 attached to the sub tank 100. This configuration enables the air/liquid replacement in the first storing chamber 53 as with the above embodiment.

Figure 9:
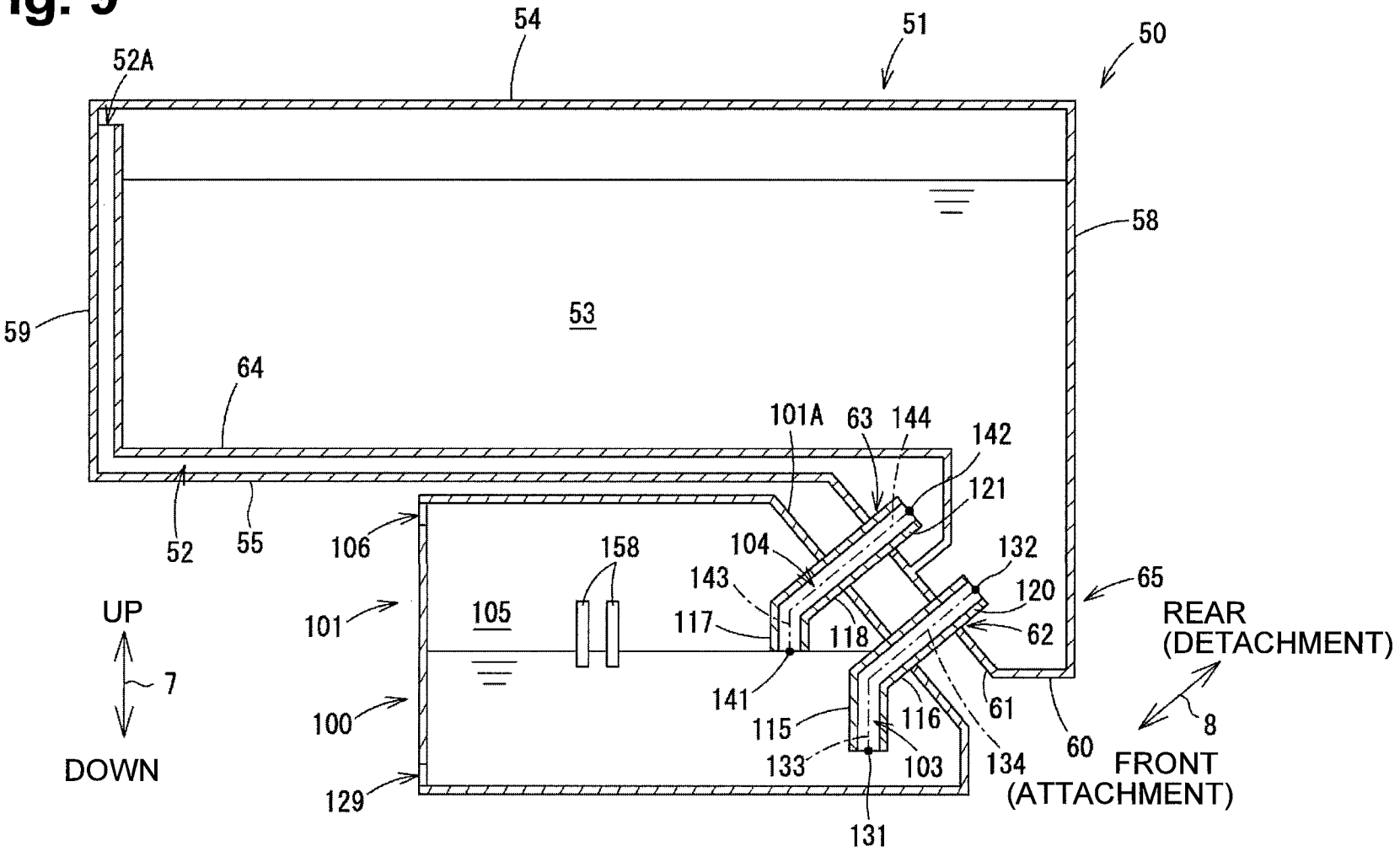
FIG. 9 is a sectional view of an ink cartridge and a sub tank, which are in an attached state, according to aspects of the disclosure.

In the ink supply apparatus 15, the attachment and detachment direction 8 is a horizontal direction. The attachment and detachment direction 8 may be a direction crossing the horizontal direction and the vertical direction as illustrated in FIG. 9. In this case, the secondary-front wall 61 constitutes an inclined front surface (an example of secondary-front surface).

In the above ink supply apparatus 15, the liquid channel 103 has the vertical portion 133 and the horizontal portion 134, and the air channel 104 has the vertical portion 143 and the extension portion 144. According to one or more aspects, the liquid channel 103 may have the horizontal portion 134 only, that is, may not have the vertical portion 133. Similarly, the air channel 104 may have the horizontal portion 144 only, that is, may not have the vertical portion 143. The horizontal portion 134 of the liquid channel 103 may be located above the horizontal portion 144 of the air channel 104.

In the above-described configuration, the first storing chamber 53 has a greater capacity than the second storing chamber 105. The first storing chamber 53 may be identical in capacity to the second storing chamber 105 or have a smaller capacity than the second storing chamber 105.

What is claimed is:

1. A liquid supply apparatus, comprising:

a tank; and a cartridge attachable to and detachable from the tank along an attachment and detachment direction crossing a vertical direction, the cartridge including:

a casing;

a first storing chamber located inside the casing and configured to store liquid therein; and a first communication port and a second communication port open in a direction where the cartridge is attached to the tank, each of the particular first communication port and the second communication port allowing the first storing chamber to communicate with an outside of the first storing chamber, the direction being parallel to the attachment and detachment direction, wherein the tank includes:

a second storing chamber configured to store liquid therein;

a liquid channel communicating with the second storing chamber;

a first joint shaped like a tube, the first joint extending in the attachment and detachment direction to define the liquid channel, the first joint being configured to, when the cartridge is attached to the tank, connect with the first communication port of the cartridge;

an air channel communicating with the second storing chamber;

a second joint shaped like a tube and spaced apart from the first joint, the second joint extending in the attachment and detachment direction to define the air channel, the second joint being configured to, when the cartridge is attached to the tank, connect with the second communication port of the cartridge; and an air communication port allowing the second storing chamber to communicate with an outside of the tank;

wherein the casing of the cartridge includes:

a front surface located in a front portion of the casing in the attachment and detachment direction;

a rear surface located in a rear portion of the casing in the attachment and detachment direction;

an upper surface located in an upper portion of the casing in the vertical direction;

a lower surface located in a lower portion of the casing in the vertical direction;

a secondary-lower surface located closer to the upper surface than the lower surface in the vertical direction, the secondary-lower surface facing downward in the vertical direction; and a secondary-front surface located closer to the rear surface than to the front surface in the attachment and detachment direction, the secondary-front surface facing frontward in the attachment and detachment direction, the secondary-front surface having both the first communication port and the second communication port, wherein, when the cartridge is attached to the tank with the first storing chamber of the cartridge communicating with the liquid channel and the air channel of the tank, the first storing chamber has a portion located above the liquid channel and the air channel in the vertical direction, and the tank is located below the secondary-lower surface in the vertical direction and faces the secondary-front surface.

2. The liquid supply apparatus according to claim 1, wherein the first joint is located below the second joint in the vertical direction.

3. The liquid supply apparatus according to claim 1, wherein the cartridge has a cartridge air channel, the cartridge air channel having an opening that is open to the first storing chamber, the cartridge air channel being configured to, when the cartridge is attached to the tank, communicate with the air channel of the tank, and wherein, when the cartridge is attached to the tank, the opening of the cartridge air channel is located above a liquid surface of an initial volume of ink stored in the first storing chamber.

4. The liquid supply apparatus according to claim 1, wherein the first storing chamber has a greater capacity than the second storing chamber has.

5. The liquid supply apparatus according to claim 1, wherein the attachment and detachment direction is a horizontal direction.

6. The liquid supply apparatus according to claim 1, wherein the attachment and detachment direction crosses a horizontal direction.

7. An image recording apparatus comprising:

the liquid supply apparatus according to claim 1; and a recording unit including a recording head connected to the tank of the liquid supply apparatus, the recording unit being configured to eject the liquid supplied from the tank.

8. A liquid supply apparatus comprising:

a tank; and a cartridge attachable to and detachable from the tank along an attachment and detachment direction crossing a vertical direction, the cartridge including:

a casing;

a first storing chamber located inside the casing and configured to store liquid therein; and a particular communication port open in a direction where the cartridge is attached to the tank, the particular communication port allowing the first storing chamber to communicate with an outside of the first storing chamber, the direction being parallel to the attachment and detachment direction, wherein the tank includes:

a second storing chamber configured to store liquid therein;

a liquid channel communicating with the second storing chamber;

an air channel communicating with the second storing chamber; and an air communication port allowing the second storing chamber to communicate with an outside of the tank;

wherein the casing of the cartridge includes:

a front surface having an upper end and a lower end in the vertical direction;

a rear surface spaced apart from the front surface, the rear surface having an upper end and a lower end lower than the lower end of the front surface in the vertical direction;

an upper surface connecting the upper end of the front surface and the upper end of the rear surface, the upper surface facing upward in the vertical direction;

a lower surface connected with the lower end of the rear surface and facing downward in the vertical direction;

a secondary-lower surface extending from the lower end of the front surface toward the rear surface, the secondary-lower surface being located closer to the upper surface than the lower surface in the vertical direction, the secondary-lower surface facing downward in the vertical direction; and a secondary-front surface connecting the lower surface and the secondary-lower surface, the secondary-front surface being located closer to the rear surface than to the front surface, the secondary-front surface having the particular communication port, wherein, when the cartridge is attached to the tank with the first storing chamber of the cartridge communicating with the liquid channel and the air channel of the tank, the first storing chamber has a portion located above the liquid channel and the air channel in the vertical direction, and the tank is located below the secondary-lower surface in the vertical direction and faces the secondary-front surface.

9. The liquid supply apparatus according to claim 8, wherein the secondary-front surface extends in the vertical direction.

10. The liquid supply apparatus according to claim 8, wherein the secondary-front surface faces in the attachment and detachment direction.

11. The liquid supply apparatus according to claim 8, wherein the attachment and detachment direction crosses a horizontal direction.

* * * * *